US005812967A

United States Patent [19]

Ponceleon et al.

[11] Patent Number: 5,812,967

[45] Date of Patent: Sep. 22, 1998

[54] RECURSIVE PITCH PREDICTOR EMPLOYING AN ADAPTIVELY DETERMINED SEARCH WINDOW

[75] Inventors: Dulce Ponceleon, Palo Alto; Roberto Manduchi, San Francisco; Ke-Chiang Chu, Saratoga; Hsi-Jung Wu, Mountain View, all of Calif.

[73] Assignee: Apple Computer, Inc., Cupertino, Calif.

[21] Appl. No.: 724,169

[22] Filed: Sep. 30, 1996

[51] Int. Cl.[6] ..... G10L 5/00

[52] U.S. Cl. ..... 704/207

[58] Field of Search ..... 704/207, 2.17, 704/218, 219, 208, 237

[56] References Cited

U.S. PATENT DOCUMENTS

| | | | |
|---|---|---|---|
| 3,979,557 | 9/1976 | Schulman et al. | 704/207 |
| 5,127,053 | 6/1992 | Koch | 704/207 |
| 5,216,747 | 6/1993 | Hardwick et al. | 704/200 |
| 5,491,772 | 2/1996 | Hardwick et al. | 704/226 |

*Primary Examiner*—David R. Hudspeth
*Assistant Examiner*—Susan Wieland
*Attorney, Agent, or Firm*—Sawyer & Associates

[57] ABSTRACT

A method for improved recursive pitch prediction includes providing a search window for pitch estimates based upon a previously computed pitch, computing pitch estimates for the search window, and determining an optimal pitch from the pitch estimates within the search window for a first predetermined number of frames. The method further includes expanding the search window to a full pitch window after the first predetermined number of frames, and calculating pitch estimates for the full pitch window for a second predetermined number of frames.

A system for improved recursive pitch prediction includes a speech generator of speech signals, and a central processing unit coupled to the speech generator. The central processing unit further is capable of coordinating pitch estimation of the speech signals, including providing a search window for pitch estimates based upon a previously computed pitch, calculating pitch estimates for the search window, and determining an optimal pitch from the pitch estimates within the search window for a first predetermined number of frames.

19 Claims, 3 Drawing Sheets

RECURSIVE PITCH PREDICTOR EMPLOYING AN ADAPTIVELY DETERMINED SEARCH WINDOW

FIELD OF THE INVENTION

The present invention relates to speech processing systems, and more particularly to recursive pitch predictors in speech processing systems.

BACKGROUND OF THE INVENTION

Digital speech processing typically can serve several purposes in computers. In some systems, speech signals are merely stored and transmitted. Other systems employ processing that enhances speech signals to improve the quality and intelligibility. Further, speech processing is often utilized to generate or synthesize waveforms to resemble speech, to provide verification of a speaker's identity, and/or to translate speech inputs into written outputs.

In some speech processing systems, speech coding is performed to reduce the amount of data required for signal representation, often with analysis by synthesis adaptive predictive coders, including various versions of vector or code-excited coders. In the predictive systems, models of the vocal cord shape. i.e., the spectral envelope, and the periodic vibrations of the vocal cord, i.e., the spectral fine structure of speech signals, are typically utilized and efficiently performed through slowly, time-varying linear prediction filters. Also often included as an integral part of the predictive systems are pitch predictors. As the name implies, pitch predictors attempt to predict the pitch of a speech signal, i.e., the representation of the long term periodicity information for the signal. Pitch predictors are typically described by one or more predictor coefficients and a parameter representing the delay in samples, which are normally determined through iterative and intensive computations.

The ever-present need for fast, efficient, and high quality speech processing systems maintains a need for always improving adaptive coders and thus improved portions of the coders. Accordingly, improved and more efficient implementations of pitch predictors are needed.

SUMMARY OF THE INVENTION

The present invention meets these needs and provides method and system aspects for improved recursive pitch prediction. In a method aspect, a method for improved recursive pitch prediction includes providing a search window for pitch estimates based upon a previously computed pitch, providing pitch estimates for the search window, and determining an optimal pitch from the pitch estimates within the search window for a first predetermined number of frames. The method further includes expanding the search window to a full pitch window after the first predetermined number of frames, and providing pitch estimates for the full pitch window for a second predetermined number of frames.

In a system aspect, a system for improved recursive pitch prediction includes a speech generator of speech signals, and a central processing unit coupled to the speech generator. The central processing unit further is capable of coordinating pitch estimation of the speech signals, including providing a search window for pitch estimates based upon a previously computed pitch, providing pitch estimates for the search window, and determining an optimal pitch from the pitch estimates within the search window for a first predetermined number of frames.

The present invention further provides a system for improved recursive pitch estimation including a speech signal generation mechanism for generating speech signals, and a speech processing mechanism for processing the generated speech signals to estimate a pitch of the speech signals. The speech processing mechanism further utilizes an adaptively determined search window, provides pitch estimates for the adaptively determined search window, and determines an optimal pitch from the pitch estimates within the adaptively determined search window.

In accordance with these aspects of the present invention, a more efficient determination of pitch estimates in a speech processing system is achieved. Further, implementation of an adaptively determined pitch interval supports faster computations without substantial loss of optimal results. These and other advantages of the present invention are more fully appreciated when taken with the following description and accompanying drawings.

DESCRIPTION OF THE INVENTION

The present invention relates to speech coding systems that predict/estimate the pitch of speech signals. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

In typical pitch predictors, estimating the pitch of a speech signal involves an exhaustive computational search over a predefined pitch interval in the frame of the speech signal e.g., a search window $[p_0, p_1]$. In a first order pitch predictor, a pitch predictor signal y(n), usually tries to estimate a speech signal, x(n), within a frame/segment of a chosen number of samples, N, e.g., N=240 samples, based on previous values of the speech signal. Typically, the pitch predictor signal y(n) is suitably represented by $y(n)=\beta\times(n-d)$; where $\beta$ represents the gain of the predictor and d, the delay, represents the pitch period in samples. The optimal predictor gain and optimal delay for a current frame are typically defined as a pair that minimizes the squared prediction error, E, between the original signal and its predicted value for the frame, where $$E = \sum_{n=0}^{N-1} (x(n) - \beta x(n-d))^2.$$

For a given delay value d, the optimal value of $\beta$, $\beta_{opt}$, is found by setting the derivative of E with respect to $\beta$ to zero, resulting in $$\beta_{opt} = \sum_{n=0}^{N-1} x(n)x(n-d) / \sum_{n=0}^{N-1} x^2(n-d),$$

as is well understood to those skilled in the art. Substituting $\beta_{opt}$ into the squared prediction error formula results in $$E = \sum_{n=0}^{N-1} x^2(n) - E',$$

where $$E' = \left[ \sum_{n=0}^{N-1} x(n)x(n-d) \right]^2 / \sum_{n=0}^{N-1} x^2(n-d).$$

Using this form of E, the other half of the optimal pair, $d_{opt}$, is determined as the delay value that maximizes E'. The determination of the optimal delay suitably provides the pitch of the signal within the current frame, since the E' function has local maxima at delays corresponding to the pitch period and its multiples, as described in "Pitch Predictors with High Temporal Resolution", by Kroon, P., et al., 1990, IEEE, pp. 661–664.

Figure 1:
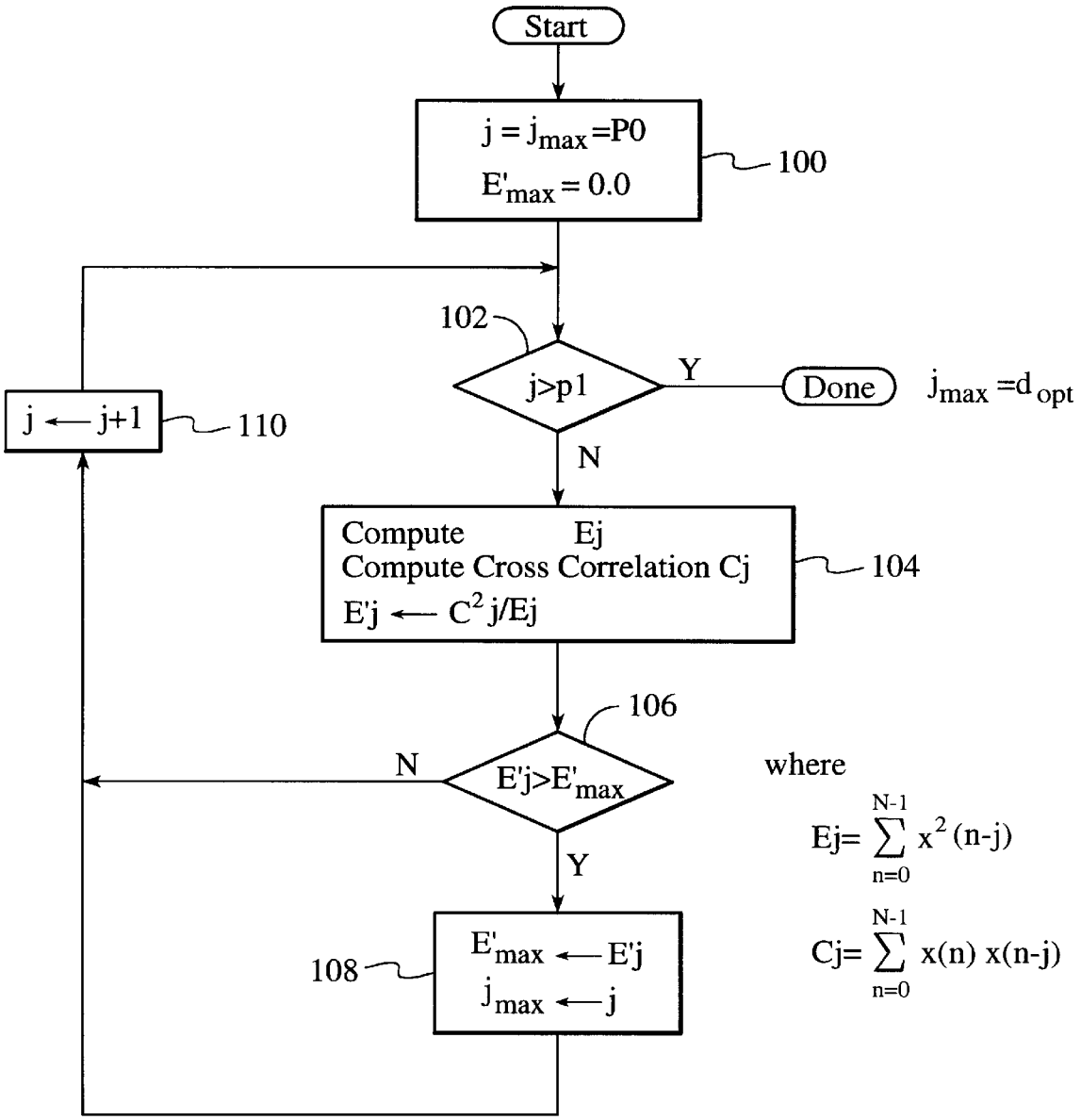
FIG. 1 illustrates a typical method of pitch prediction.

FIG. 1 illustrates a flow diagram of the typical process involved in the computations for determining the optimal delay. In general the computations involve comparing the results from computing a value for E' with each pitch value within the search window to determine the optimal pitch, $d_{opt}$, that results in a maximum value for E'. Initialization of the process variables occurs with an index value, j, set to one limit of the search window, e.g., $p_0$, and the maximum value for $E'_{max}$ set to zero (step 100). The index value j is then compared to the value for the opposite end of the window, e.g., $p_1$, (step 102). When the index value has not exceeded the opposite end of the search window, $E_j$ and the cross-correlation, correlation, $C_j$, are calculated with the current index value (step 104), where $$E_j = \sum_{n=0}^{N-1} x^2(n-j) \text{ and } C_j = \sum_{n=0}^{N-1} x(n)x(n-j),$$

as is well understood by those skilled in the art. Further computed in step 104 is $C^2_j/E_j$, the result of which sets the value $E'_j$.

A comparison between $E'_j$ and $E'_{max}$ is performed (step 106) to determine whether the computed value $E'_j$ exceeds the value of $E'_{max}$. When the value of $E'_j$ exceeds $E'_{max}$, the value for $E'_{max}$ is updated to the $E'_j$ value and the current index value j sets a maximum index value $j_{max}$ (step 108) to mark the current index value for the current optimal pitch value. When the value of $E'_j$ does not exceed $E'_{max}$, or upon completion of the updating of $j_{max}$, the index value j is incremented (step 110), and the process repeats at the next index value until every value within the search window has been tested, i.e., step 102 is affirmative. Once completed, the optimal delay $d_{opt}$ is equal to the value indexed by the saved index value $j_{max}$ While such determinations do result in the determination of an optimal delay, and thus the pitch of the current signal the efficiency is hampered by requiring computation of $E'_j$ for every pitch value within the search window $[p_0, p_1]$ of every frame of the speech signal. The present invention takes to advantage the observation that, generally, speech signals do not change abruptly from one frame to the next, so that the optimal pitch should not change abruptly between frames. Thus, the present invention reduces the complexity of pitch prediction and estimation by utilizing an inter-frame correlation of the pitch in speech signals.

Figure 2:
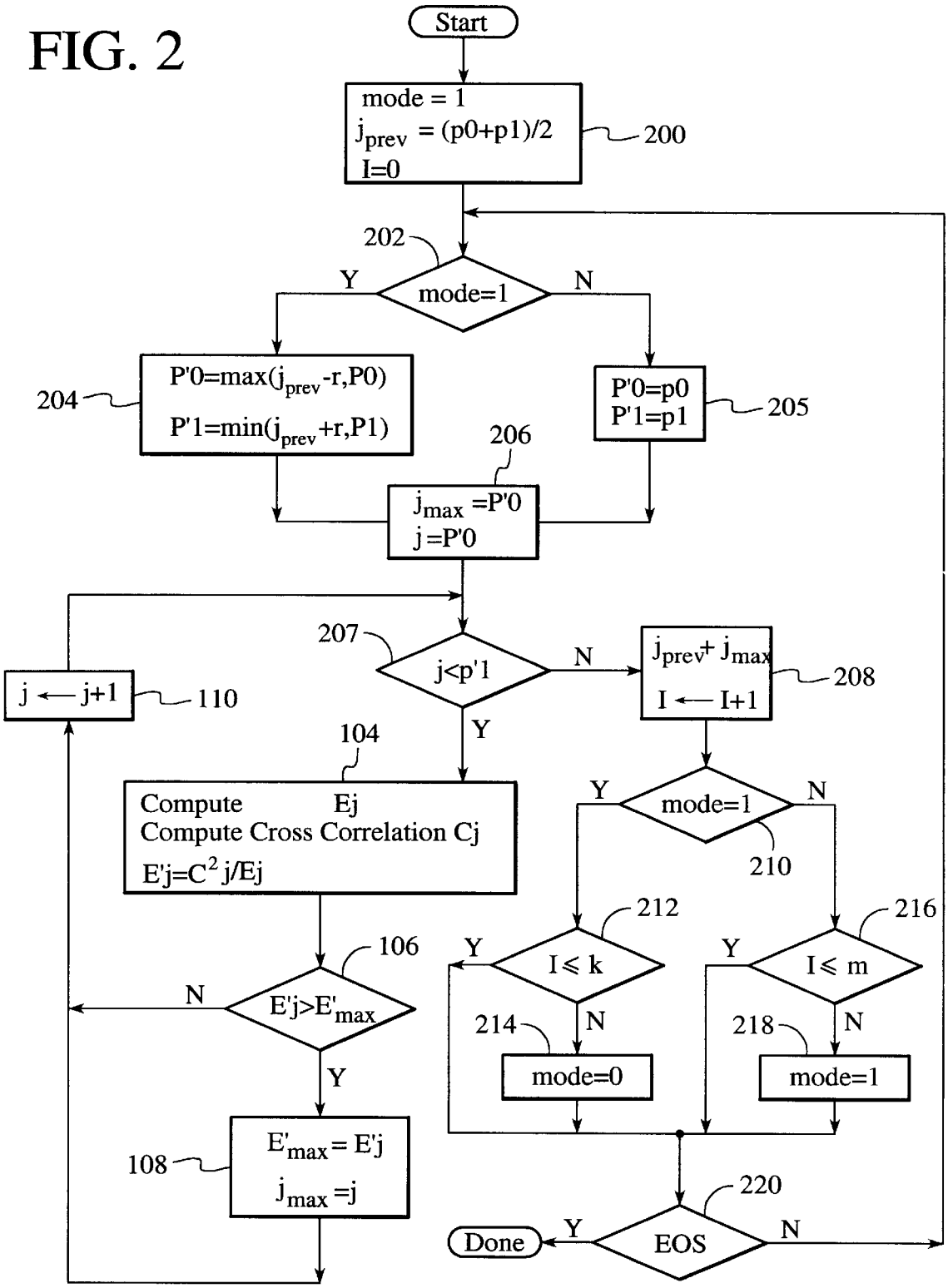
FIG. 2 illustrates pitch prediction in accordance with the present invention.

The flow diagram of FIG. 2 illustrates more particularly the features of a pitch predictor computation in accordance with a preferred embodiment of the present invention. In general the pitch predictor of the present invention performs calculations similar to the prior art, but achieves more efficiency by adaptively defining a restricted search window based on an optimal pitch of a previous frame. In a preferred embodiment, the present invention further allows, after a certain number of pitch calculations, the search window to be equal to the exhaustive search window as used in the prior art, as is described in more detail in the following discussion with reference to FIG. 2.

The process begins with the initialization of a 'mode' variable to one, a counter variable 'I' to zero, and a previous pitch variable $j_{prev}$ to the midpoint value of the exhaustive search window, i.e., $j_{prev}=(p_0+p_1)/2$, (step 200). The mode variable suitably allows selection of the type of computation used to determine the pitch. By way of example, setting of the mode variable to one allows computation to occur using the adaptively determined search window, in accordance with the present invention. Conversely, setting of the mode variable to zero allows computation of the pitch to occur using the exhaustive method as described with reference to FIG. 1. Of course, the values of the mode variables for selecting a method are is alterable, and the numbers used herein are meant as illustrative and not restrictive of the present invention. This ability to choose the employed method achieves greater flexibility and takes into consideration the possibility that the adaptively determined search window may restrict the estimation too much for those frames whose optimal pitch falls outside the adaptively determined search window.

Depending upon the value of the mode variable, as determined in step 202, the values for the adaptively determined search window $[p'_0, p'_1]$, the maximum index value $j_{max}$, and the current index value j, are set accordingly. For the adaptive system (step 204) when the variable mode is equal to 1, in accordance with the present invention, the maximum window length is set equal to (2r+1), where r is a suitably chosen constant.

For example, a value of r equal to approximately one third the length of the exhaustive search window has been found by the inventors to work well. Thus, one limit of the adaptively determined search window, $p'_0$, is set equal to the maximum between the previous pitch index value, $j_{prev}$, minus a chosen displacement r, and the lower end of the exhaustive search window, $p_0$. The opposite value of the adaptively determined search window, $p'_1$, is set equal to the minimum between the previous index value, $j_{prev}$, plus r, and the upper end of the exhaustive search window, $p_1$. Thus, the adaptive search window is guaranteed to lie within the limits of the exhaustive search window. For the exhaustive system (step 205) when the variable mode is set to 0, the adaptively determined search window values are set equal to the window limit values of the exhaustive approach, i.e., $p'_0$ is set equal to $p_0$, and $p'_1$ is set equal to $p_1$. In a first iteration, the maximum index value $j_{max}$ and current index value j are suitably set to $p'_0$ (step 206).

Once the adaptively determined search window values and index values have been set, the process continues by determining whether the entire range of the adaptively determined search window has been tested, i.e., whether $j<p'_1$ (step 207). If the entire adaptively determined search window has not been tested, the process continues by computing the maximum E and j as described with reference to FIG. 1 (steps 104, 106, 108, and 110). Once the entire adaptively determined search window has been tested, the previous search window index value $j_{prev}$ is set equal to the maximum search window index value $j_{max}$, and the counter I is incremented (step 208). Thus, while processing in the adaptive mode, the present invention relates a previously computed optimal pitch estimate indexed by $j_{max}$ with the use of the $j_{prev}$ index variable, so that the pitch search window is adaptively determined based on calculations of a previous frame.

Before determining an optimal pitch for a next frame, a determination of whether the current mode should be switched is suitably performed. While in the adaptive mode of the present invention, as determined via step 210, the value of counter I is compared to a set variable value k (step 212), where k is some chosen value representing the number of times the use of the adaptive mode is desired, for example k=5. Thus, when the counter value I exceeds the chosen value k, the mode is switched (step 214) to allow a next chosen number of frames to be processed using the exhaustive method. When not in the adaptive mode, the counter value is compared against a set variable m (step 216), where m represents a predetermined number of times the use of the exhaustive mode is desired, for example m=1. When the counter value I exceeds the predetermined value m, the mode is switched (step 218), to allow processing by the adaptive mode to again occur. The processing continues in the appropriate mode until an end of signal occurs to indicate no more frames are present for processing (step 220).

Figure 3:
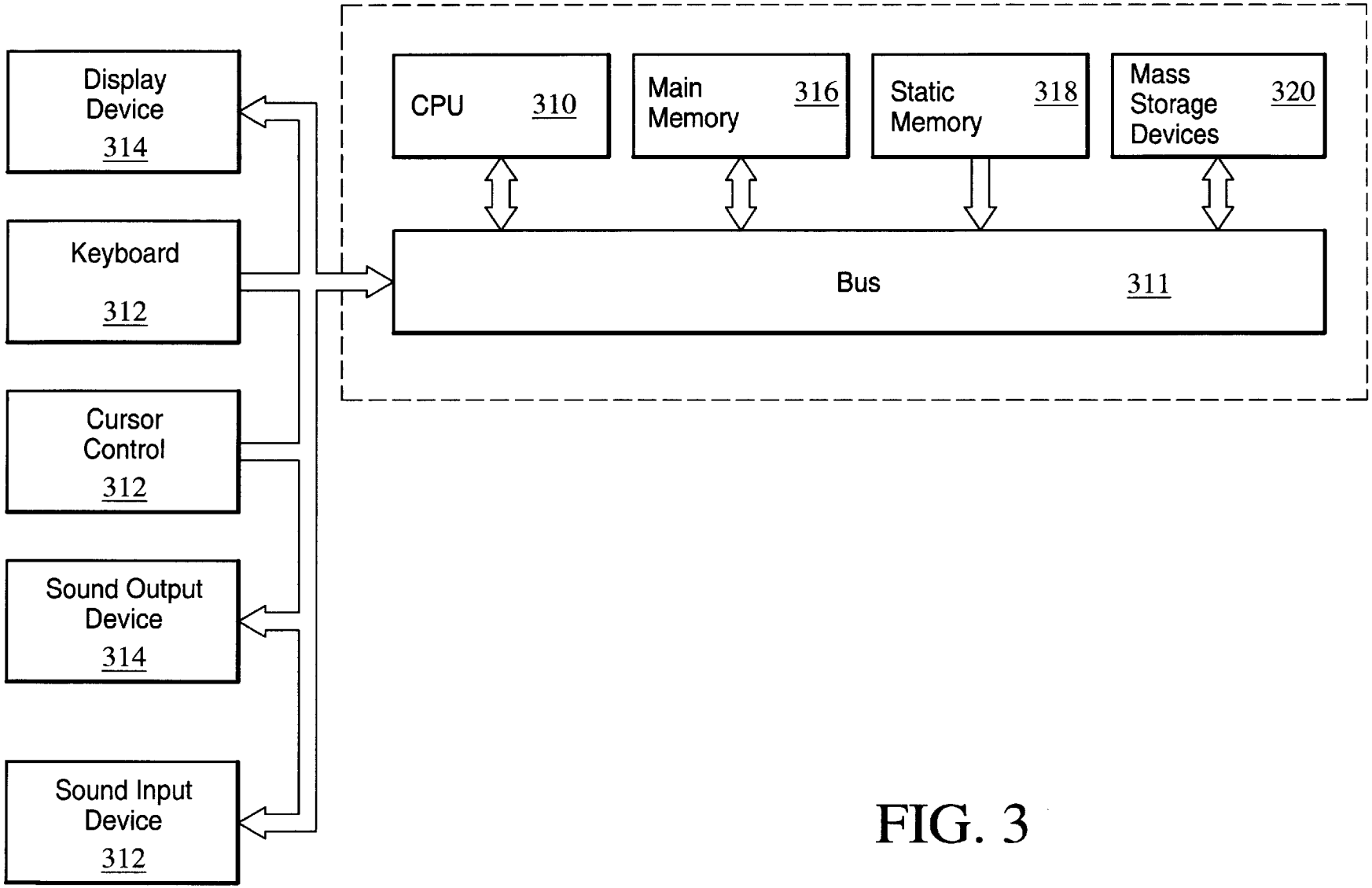
FIG. 3 illustrates a block diagram of a computer system capable of utilizing pitch prediction in accordance with the present invention.

As mentioned above, pitch predictors are normally a part of a speech processing system within a computer system. FIG. 3 illustrates a block diagram of a computer system capable of coordinating speech processing including the pitch prediction in accordance with the present invention. Included in the computer system are a central processing unit (CPU) 310, coupled to a bus 311 and interfacing with one or more input devices 312, including a cursor control/mouse/stylus device, keyboard, and speech/sound input device, such as a microphone, for receiving speech signals. The computer system further includes one or more output devices 314, such as a display device/monitor, sound output device/speaker, printer, etc, and memory components, 316, 318, e.g., RAM and ROM, as is well understood by those skilled in the art. Of course, other components, such as A/D converters, digital filters, etc., are also suitably included for speech signal generation of digital speech signals, e.g., from analog speech input, as is well appreciated by those skilled in the art. The computer system preferably controls operations necessary for the speech processing including the pitch prediction of the present invention, suitably performed using a programming language, such as C, C++, and the like, and stored on an appropriate storage medium 320, such as a hard disk, floppy diskette, etc.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for improved recursive pitch prediction in digital speech signal processing, the method comprising the steps of:

a) utilizing a search window that falls within a full pitch window for pitch estimates based upon a location of a previously computed pitch within the search window;

b) determining pitch estimates for the search window; and c) determining an optimal pitch from the pitch estimates within the search window for a first predetermined number of frames, wherein inter-frame correlation of pitch in speech signals is better estimated.

2. The method of claim 1 further comprising expanding the search window to the full pitch window after the first predetermined number of frames.

3. The method of claim 2 further comprising the steps of:

d) determining estimates for the full pitch window; and e) determining an optimal pitch estimate within the full pitch window for a second predetermined number of frames.

4. The method of claim 3 further comprising repeating steps a–c after the second predetermined number of frames.

5. The method of claim 1 wherein step (a) further comprises selecting a first limit of the search window at a maximum value between a previous pitch index value less a chosen displacement and a lower end of the full pitch window.

6. The method of claim 5 wherein step (a) further comprises selecting a second limit of the search window at a minimum value between the previous pitch index value plus the chosen displacement and an upper end of the full pitch window.

7. The method of claim 6 wherein the chosen displacement is approximately equal to one-third of the full pitch window length.

8. A system for improved recursive pitch prediction in digital speech signal processing comprising:

means for generating digital speech signals; and a central processing unit, the central processing unit coupled to the speech generator and capable of coordinating pitch estimation of the speech signals, the pitch estimation comprising providing a search window within a full pitch window for pitch estimates based upon a location of a previously computed pitch within the search window, calculating pitch estimates for the search window, and determining an optimal pitch from the pitch estimates within the search window for a first predetermined number of frames.

9. The system of claim 8 wherein the pitch estimation further comprises expanding the search window to the full pitch window after the first predetermined number of frames.

10. The system of claim 9 wherein the pitch estimation further comprises computing pitch estimates for the full pitch window for a second predetermined number of frames.

11. The system of claim 8 wherein the pitch estimation further comprises selecting a first limit of the search window at a maximum value between a previous pitch index value less a chosen displacement and a lower end of the full pitch window.

12. The system of claim 11 wherein the pitch estimation further comprises selecting a second limit of the search window at a minimum value between the previous pitch index value plus the chosen displacement and an upper end of the full pitch window.

13. The system of claim 12 wherein the chosen displacement is approximately equal to one-third of the full pitch window length.

14. A system for improved recursive pitch estimation comprising:

speech signal generation means for generating speech signals; and speech processing means for processing the generated speech signals to estimate a pitch of the speech signals by utilizing an adaptively determined search window, the adaptively determined search window comprising a smaller window within an exhaustive search window, providing pitch estimates for the adaptively determined search window, and determining an optimal pitch from the pitch estimates within the adaptively determined search window.

15. The system of claim 14 wherein the adaptively determined search window results from reducing the exhaustive search window based upon a pitch estimate computed for a previous frame.

16. The system of claim 15 wherein the speech processing means further selects a first limit of the search window at a maximum value between a previous pitch index value less a chosen displacement and a lower end of the exhaustive search window.

17. The system of claim 16 wherein the speech processing means further selects a second limit of the search window at a minimum value between the previous pitch index value plus the chosen displacement and an upper end of the exhaustive search window.

18. The system of claim 17 wherein the chosen displacement is approximately equal to one-third of the exhaustive search window length.

19. A computer readable medium containing program instructions for improved recursive pitch prediction in digital speech signal processing, the program instructions comprising:

a) utilizing a search window that falls within a full pitch window for pitch estimates based upon a location of a previously computed pitch within the search window;

b) determining pitch estimates for the search window; and c) determining an optimal pitch from the pitch estimates within the search window for a first predetermined number of frames, wherein inter-frame correlation of pitch in speech signals is better estimated.

* * * * *